US008588451B2

(12) United States Patent
Matsunaga

(10) Patent No.: US 8,588,451 B2
(45) Date of Patent: Nov. 19, 2013

(54) ELECTRET CONDENSER MICROPHONE

(75) Inventor: Susumu Matsunaga, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 68 days.

(21) Appl. No.: 13/103,190

(22) Filed: May 9, 2011

(65) Prior Publication Data

US 2011/0280418 A1 Nov. 17, 2011

(30) Foreign Application Priority Data

May 11, 2010 (JP) ..... 2010-109699

(51) Int. Cl.
*H04R 25/00* (2006.01)

(52) U.S. Cl.
USPC ..... 381/355; 381/174; 381/369

(58) Field of Classification Search
USPC ..... 381/174, 191, 355–359, 361–363, 381/368–369
See application file for complete search history.

(56) References Cited

U.S. PATENT DOCUMENTS 7,050,597 B2 * 5/2006 Akino ..... 381/356
7,623,671 B2 * 11/2009 Akino ..... 381/356

FOREIGN PATENT DOCUMENTS

JP 411068 4/2008

* cited by examiner

*Primary Examiner* — Suhan Ni
(74) *Attorney, Agent, or Firm* — Whitham Curtis Christofferson & Cook, PC

(57) ABSTRACT

An electret condenser microphone includes a microphone capsule having a diaphragm, a fixed electrode and an extraction electrode. The extraction electrode includes a closed-bottomed cylinder composed of a conductive material. The fixed electrode has holes extending from an air chamber between the diaphragm and the fixed electrode to an air chamber within the extraction electrode, and is fixed to a shoulder of the extraction electrode to form the air chamber that serves as acoustic capacitor within the extraction electrode.

7 Claims, 6 Drawing Sheets

RELATED ART

RELATED ART

RELATED ART

ELECTRET CONDENSER MICROPHONE

BACKGROUND OF THE INVENTION

1. Field of the Invention

The present invention relates to an electret condenser microphone, and specifically, a compact electret condenser microphone having excellent frequency characteristics and high sensitivity.

2. Related Background Art

A condenser microphone mainly comprises a diaphragm that vibrates in response to sound waves and a fixed electrode that faces the diaphragm with a slight gap therebetween. The diaphragm and the fixed electrode define a capacitor. When the diaphragm vibrates in response to the sound waves, the capacitance of the capacitor varies. For example, the condenser microphone outputs a variation in capacitance of the condenser microphone as a variation in voltage. The condenser microphone has any directivity by modifying its structure.

The diaphragm of the condenser microphone is composed of a metalized synthetic-resin thin film. A back electret microphone has an electret dielectric film on the surface (facing the diaphragm) of the fixed electrode. A film electrets microphone has an electret dielectric film on the surface of a diaphragm.

FIGS. 4 to 6 illustrate an example conventional condenser microphone which is substantially the same as that disclosed in Japanese Patent No. 4110068. In FIGS. 4 to 6, the condenser microphone includes a microphone capsule 10 and a microphone case 20 which are detachable from each other by turning a male-thread joint ring 30. The microphone capsule 10 has a cylindrical capsule case 11 composed of metal such as brass. A front acoustic terminal 111 is provided on the front end surface of the capsule case 11 while a rear acoustic terminal 112 is adjacent the rear end of peripheral surface of the capsule case 11. The front acoustic terminal 111 has slit openings. The rear acoustic terminal 112 includes a plurality of circular holes disposed at regular intervals in a circumferential direction.

The microphone case 20 is a cylindrical body made of metal such as brass and houses a circuit board 21 therein which includes an FET 211 serving as an impedance converter. A microphone cable 23 is fixed to the rear end of the microphone case 20 optionally with a clamp or a cable bushing. A female thread 114 that is screwed into the male-thread joint ring 30 is provided on the inner peripheral surface adjacent a rear opening of the capsule case 11. A female thread 204 that is screwed into the male-thread joint ring 30 is provided on the inner peripheral surface adjacent a front opening of the microphone case 20.

A diaphragm 12, a spacer 122, a fixed electrode 13, a support 14 that supports the fixed electrode 13 and an insulating sleeve 16 are inserted into the capsule case 11 in this order from the rear opening of the capsule case 11. The capsule case 11 is provided with a side mesh 17 which protects the rear acoustic terminal 112 against intrusion of dust and foreign substances but does not function as an acoustic resistor. The diaphragm 12 is composed of a metalized synthetic-resin thin film. The diaphragm 12 is fixed to a support ring 121 made of brass or the like under predetermined tension and is housed in the capsule case 11 via the support ring 121. A step 113 in the capsule case 11 positions the support ring 121.

A fixed electrode 13 of an electret board composed of an aluminum plate on which an electret material of fluorinated ethylene propylene resin (FEP) or the like having a thickness of about 25 μm has self polarization effects and requires no polarization power supply. A fixed electrode 13 composed of a metallic plate, however, needs polarization power supply. The fixed electrode 13 has a predetermined number of holes extending from the front surface to the back surface of the electrode. The diaphragm 12 is composed of a metalized synthetic-resin thin film. The fixed electrode 13 of a back electret microphone has an electret dielectric film on the surface (facing the diaphragm) thereof. The diaphragm 12 of a film electrets microphone has an electret dielectric film on the surface thereof.

The support 14 includes a column having a large-diameter segment 141 that can support a fringe of the fixed electrode 13 and a small-diameter segment 142 concentrically integrated to the rear end of the support 14. An acoustic resistor 151 and a damper 152 are housed in the large-diameter segment 141. The acoustic resistor 151 is composed of a fine mesh material, for example. The damper 152 biases the acoustic resistor 151 against the bottom of the large-diameter segment 141 and is composed of air-permeable sponge, for example.

The small-diameter segment 142 has an enough length to contact to the gate of the FET 211 when the microphone capsule 10 and the microphone case 20 are connected. The inner peripheral surfaces of the large-diameter segment 141 and the small-diameter segment 142 communicate with each other. The small-diameter segment 142 has a plurality of sound inlets 143 sound from the rear acoustic terminal 112 enters. Accordingly, the sound passes from the rear acoustic terminal 112 to the small-diameter segment 142 through the sound inlets 143, and then the sound is introduced to the large-diameter segment 141, the fixed electrode 13 and then the back surface of the diaphragm 12 via through holes (not shown). On the way to the diaphragm 12, the sound is acoustically resisted by the acoustic resistor 151.

Sound leakage, which is the sound flow that reaches the back surface of the diaphragm 12 with the sound avoiding the acoustic resistor 151, is mainly generated by the sound passing from a step 144 (see FIG. 6) on the inner peripheral surface of the large-diameter segment 141 and the small-diameter segment 142 of the support 14 to the radial direction of the large diameter-columns 141. According to the example of the unidirectional microphone mentioned above, since the large-diameter and small-diameter segments 141, 142 are concentrically disposed in the longitudinal direction, the contact area between the step 144 and the acoustic resistor 151 can be increased by increasing the area of the step 144 even in a microphone capsule 10 having small diameter. Accordingly, the inner diameter of the large-diameter segment 141 is designed to be as large as possible, while the inner diameter of the small-diameter segment 142 is designed to be as small as possible. Accordingly, the fluctuation of the acoustic resistance against the sound from the rear acoustic terminal 112 to the diaphragm 12 is reduced and the small-diameter directional capacitor microphone has a small fluctuation in the directional frequency response, the sensitivity and the signal-to-noise ratio.

A unidirectional condenser microphone includes an acoustic cavity (air chamber) and an acoustic resistor on the back of the fixed electrode 13 for obtaining unidirectionality. Typically, the acoustic cavity (air chamber) is formed of an insulating spacer that supports the fixed electrode 13. The acoustic resistor is disposed on the rear opening of the insulating spacer so as to form an acoustic circuit for obtaining the unidirectionality. The unidirectional condenser microphone further includes an extraction electrode for leading signals from the fixed electrode 13. Conventionally, the support 14 having the large- and small-diameter segments 141, 142 is composed of a conducting material and serves as the extraction electrode for electrically connecting the fixed electrode 13 to the FET 211. The small-diameter segment 142 has a hole on its peripheral wall which serves as a rear acoustic terminal 112. The support 14 serves as an acoustic cavity (air chamber). Accordingly, a unidirectional condenser microphone having a small-diameter column can be achieved. These features of such a condenser microphone are used for an electret condenser microphone which has is self-polarization effects and needs no other polarization power supply.

The electret condenser microphone explained above includes a stray capacitor formed between the outer periphery of the diaphragm 12 which does not vibrate in response to sound and the fixed electrode 13, in addition to the capacitance of the capacitor formed between the diaphragm 12 and the fixed electrode 13. A large stray capacitance disadvantageously has affects of a reduction in sensitivity and an increase in distortion on the acoustic performances of the electret condenser microphone. A smaller condenser microphone is more significantly affected by the stray capacitance. Furthermore, in the electret condenser microphone disclosed in Japanese Patent No. 4110068, the support 14 biases the fixed electrode 13. If the support 14 biases the fixed electrode 13 with unexpected large biasing force upon assembling the microphone, the capacitance of the capacitor varies. Accordingly, the electret condenser microphone has disadvantages in decreasing the acoustic performances such as frequency characteristics or sensitivity.

SUMMARY OF THE INVENTION

An object of the present invention is to improve the above-described conventional electret condenser microphone and to provide an electret condenser microphone includes an extraction electrode provided with an air chamber that serves as an acoustic capacitor. The electret condenser microphone is insusceptible to affects caused by the size of the stray capacitance and prevents disadvantages in decreasing the acoustic performances such as frequency characteristics or sensitivity during assembling the microphone and biasing the fixed electrode by external force.

According to an aspect of the present invention, an electrets condenser microphone includes a microphone capsule including: a diaphragm that vibrates in response to sound waves; a fixed electrode that faces the diaphragm and configures a capacitor with the diaphragm; and an extraction electrode for electrically connecting electric circuit members and the surface of the fixed electrode remote from the surface that faces the diaphragm, in which the extraction electrode comprises a closed-bottomed cylinder composed of a conductive material, the fixed electrode has holes extending from an air chamber formed between the diaphragm and the fixed electrode to an air chamber within the extraction electrode, and the fixed electrode is fixed to a shoulder of the extraction electrode to form the air chamber that serves as an acoustic capacitor within the extraction electrode.

DESCRIPTION OF THE PREFERRED EMBODIMENTS

Figure 4:
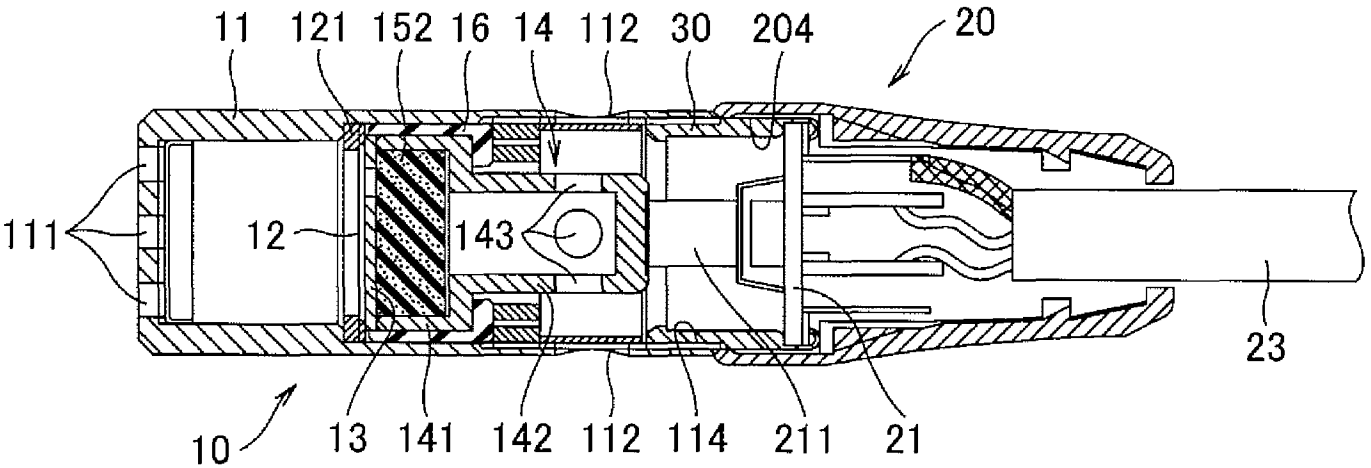
FIG. 4 is a vertical cross-sectional view of a typical conventional electret condenser microphone.
Figure 5:
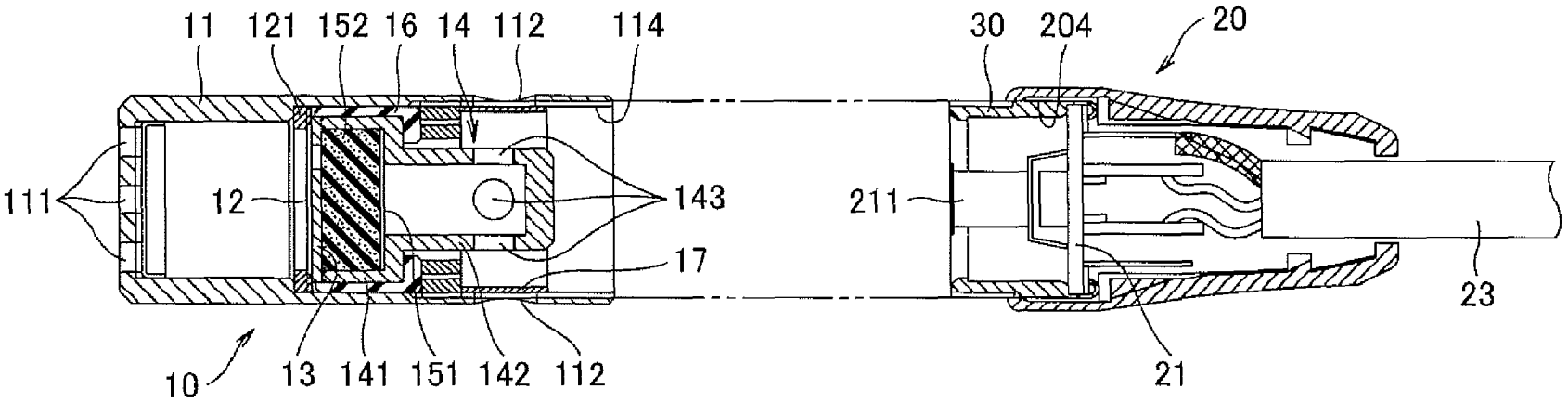
FIG. 5 is a vertical cross-sectional view of the typical conventional electret condenser microphone and an electret microphone case which are separated.
Figure 6:
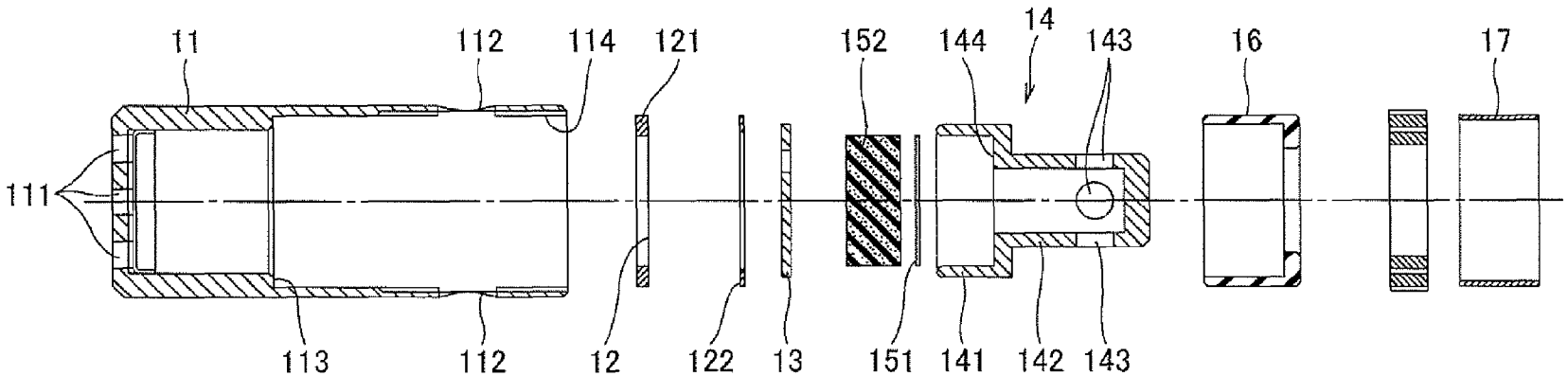
FIG. 6 is an exploded vertical cross-sectional view of a typical conventional electret microphone capsule.

An embodiment of an electret condenser microphone according to the present invention is explained below in detail with reference to FIGS. 1 to 3. Elements and parts similar to those in the conventional electret condenser microphones shown in FIGS. 4 to 6 are given the same reference numerals.

Figure 1:
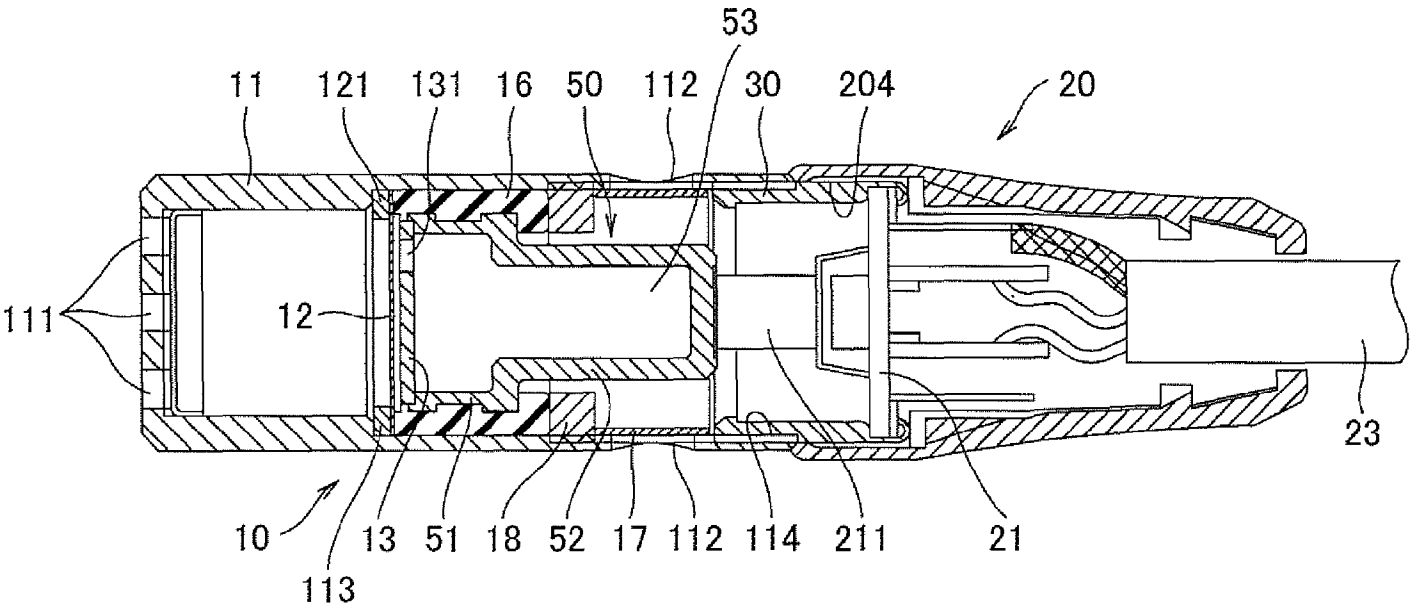
FIG. 1 is a vertical cross-sectional view of an electret condenser microphone according to an embodiment of the present invention.
Figure 2:
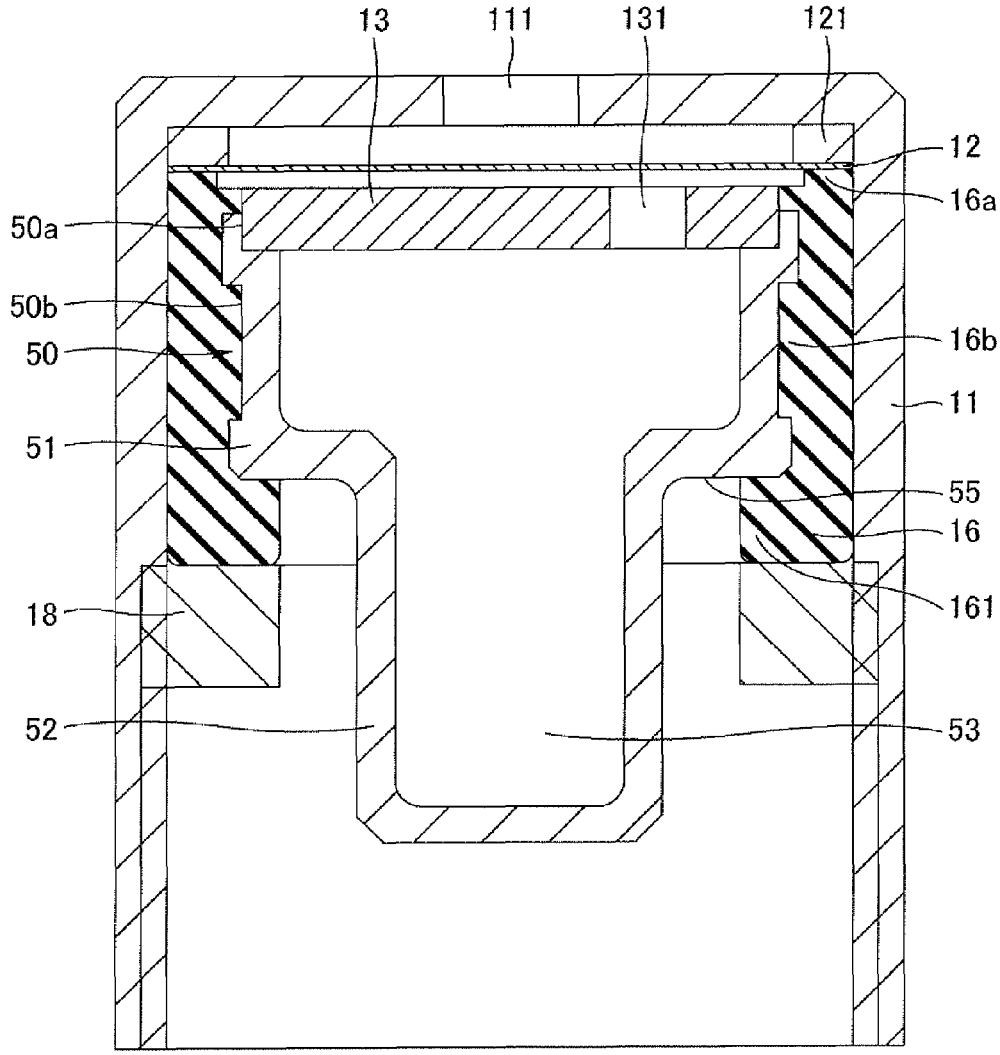
FIG. 2 is a vertical cross-sectional view of an electret microphone capsule according to the embodiment of the present invention.
Figure 3:
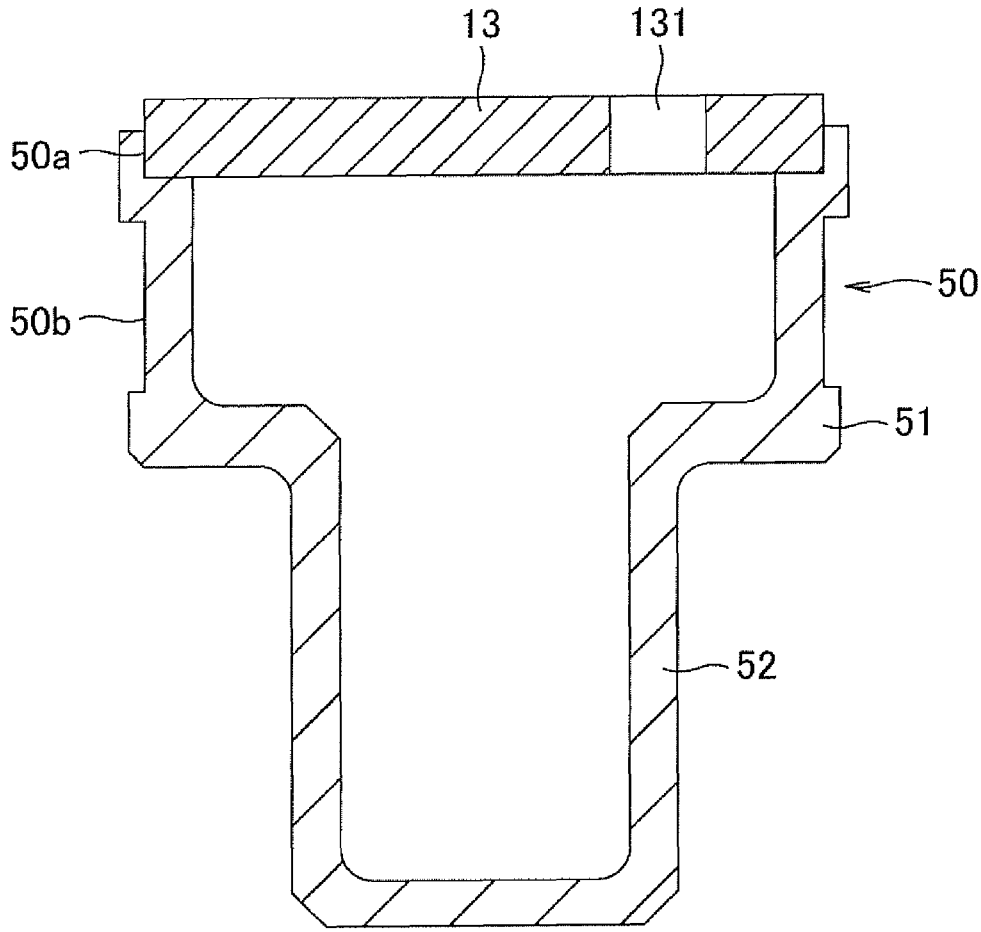
FIG. 3 is a vertical cross-sectional view of an extraction electrode and a fixed electrode.

FIGS. 1 to 3 illustrates an embodiment of the electret condenser microphone that includes a microphone capsule 10 and a microphone case 20 which are detachably assembled by turning a male-thread joint ring 30. The microphone capsule 10 includes a cylindrical capsule case 11 composed of metal such as brass. A front acoustic terminal 111 is formed on the front surface of the microphone capsule 10 while a rear acoustic terminal 112 is formed on the peripheral surface adjacent the rear end of the capsule case 11. The front acoustic terminal 111 is slit openings. The multiple circular rear acoustic terminals 112 are disposed at regular intervals in the circumferential direction.

FIGS. 2 and 3 depict a feature of the electret condenser microphone according to the present invention which includes an extraction electrode 50, an insulating sleeve 16, and a fixed electrode 13. The extraction electrode 50 is composed of a conductive material and is a closed-bottomed cylinder. The fixed electrode 13 has holes 131 extending from an air chamber between the diaphragm 12 and the fixed electrode 13 to an air chamber 53 within the extraction electrode 50. The fixed electrode 13 is fixed to a shoulder 50*a* along the entire inner periphery of the opening at the end of a large-diameter column segment 51 of the extraction electrode 50 to form the air chamber 53 that serves as an acoustic capacitor within the extraction electrode 50. The front acoustic terminal 111 may be located at a distance from the diaphragm 12 as shown in FIG. 1 or adjacent the diaphragm 12 as shown in FIG. 2.

The microphone case 20 is composed of cylindrical metal such as brass and houses a circuit board 21 which includes an FET 211 serving as an impedance converter. Throughout the specification electrical members including an FET and a circuit board is referred to as electrical circuit members. A microphone cable 23 is fixed to the rear end of the microphone case 20 with a clamp or a cable bushing. Each of the microphone cables 23 is connected to a predetermined position of the electrical circuit members. A female thread 114 that is screwed into a male thread in the front of the male-thread joint ring 30 is provided on the inner peripheral surface of the opening at the rear end of the capsule case 11. A female thread 204 that is screwed into a male thread in the rear of the male-thread joint ring 30 is provided on the inner peripheral surface of the opening at the front end of the microphone case 20.

With reference to FIG. 1, the capsule case 11 contains the components such as the diaphragm 12, the fixed electrode 13, the extraction electrode 50 that serves as a support for the fixed electrode 13, and the insulating sleeve 16, which are inserted from the opening at the rear end of the capsule case 11. A biasing ring 18 is screwed from the rear of the cylindrical insulating sleeve 16 into a female thread formed on the inner peripheral surface of the capsule case 11. The biasing ring 18 biases the insulating sleeve 16 by an appropriate biasing force. Accordingly, the components are positioned to be fixed in the capsule case 11. The side mesh 17 is assembled from the rear of the urging ring 18 in the capsule case 11 and covers the rear acoustic terminal 112 from the inner peripheral surface of the capsule case 11. The side mesh 17 protects the rear acoustic terminal 112 against intrusion of dust and foreign substances but does not function as an acoustic resistor. The diaphragm 12 is composed of a metalized synthetic-resin thin film. The diaphragm 12 is fixed to a support ring 121 that is composed of brass under predetermined tension, and is housed in the capsule case 11 via the support ring 121. A step 113 in the capsule case 11 positions the support ring 121.

A fixed electrode 13 of an electret board composed of an aluminum plate on which an electret material of fluorinated ethylene propylene resin (FEP) or the like having a thickness about 25 μm has self-polarization effects and requires no polarization power supply. A fixed electrode 13 composed of a metallic plate, however, needs polarization power supply. The fixed electrode 13 has an appropriate number of holes 131.

As illustrated in FIG. 1, the extraction electrode 50 is disposed in the microphone capsule 10 that is connected to the microphone case 20. The fixed electrode 13 is electrically connected to the electrical circuit components via the extraction electrode 50. The microphone capsule 10 includes the capsule case 11 that accommodates the components including the diaphragm 12, fixed electrode 13, and the extraction electrode 50.

FIGS. 2 and 3 depict the extraction electrode 50 including a large diameter-column 51 that has a shoulder 50*a* capable of supporting the fringe of the fixed electrode 13; and a column including a small-diameter column segment 52 that has a smaller diameter than that of the large-diameter column segment 51 and is concentrically integrated to the rear end of the extraction electrode 50. The fixed electrode 13 is fixed to the shoulder 50*a* provided on the entire inner peripheral surface of the open end of the large-diameter column segment 51. As explained above, the fixed electrode 13 and the extraction electrode 50 form the air chamber 53 that serves as an acoustic capacitor. The extraction electrode 50 has a jaw-shaped step 55 that expands in the radial direction on the outer periphery between the large-diameter column segment 51 and the small-diameter column segment 52. The step 55 is biased by an inwardly-bowed flange 161 of the insulating sleeve 16. The cylindrical insulating sleeve 16 has a convex portion 16*a* on its fringe of the end adjacent the diaphragm 12. The convex portion 16*a* supports the fringe of the diaphragm 12. The fixed electrode 13 is arranged so as to being approximately concentric with the insulating sleeve 16 and to face the diaphragm 12. The size of the convex portion 16*a* is determined so as to form a gap between the fixed electrode 13 and the diaphragm 12. The outer peripheral surface of the large-diameter column segment 51 and the inner periphery of the insulating sleeve 16 are attached firmly by insert molding. That is to say, the insulating sleeve 16 is integrated to the extraction electrode 50 by insert molding and is interposed between the outer peripheral surface of the large-diameter column segment 51 and the inner peripheral surface of the capsule case 11. Note that the fixed electrode 13 may be fixed to the insulating sleeve 16 by any appropriate means other than that of the above-described embodiment. For example, after fixation of the fixed electrode 13 to extraction electrode 50 by appropriate means such as attaching, biasing or fitting, the fixed electrode 13 is fixed to the insulating sleeve 16 by means such as attaching, biasing or fitting so as to have a predetermined interval between the diaphragm 12 and the fixed electrode 13. A concave portion 50*b* is formed on the fringe of the large-diameter column segment 51 for easy fixation to the insulating sleeve 16. A convex portion 16*b* is formed on the inner periphery of the insulating sleeve 16 so as to fit the concave portion 50*b*.

This structure allows the predetermined gap between the fixed electrode 13 and the diaphragm 12 to be provided without spacer, the entire facing surface between the fixed electrode 13 and the diaphragm 12 can function as an effective capacitor, and, thus, stray capacitance can be reduced. Accordingly, the electret condenser microphone can prevent a decrease in the acoustic performances such as a reduction in sensitivity and an increase in distortion. Since the fixed electrode 13 is assembled without direct biasing force, the electret condenser microphone does not have problems on the acoustic performances by biasing the fixed electrode 13 with external biasing force on assembling the microphone. Moreover, since a spacer is not needed between the diaphragm 12 and the fixed electrode 13, the number of components and steps for assembling is reduced and, thus, the manufacturing costs can be reduced.

As illustrated in FIG. 1, the inner peripheral surfaces of the large- and small-diameter column segments 51, 52 are continuatively communicate with each other to form the chamber 53. The rear-half of the small-diameter column segment 52 of the extraction electrode 50 is exposed rearwards from the rear end of the biasing ring 18. The small-diameter column segment 52 has an enough length to make contact with a gate electrode of the FET 211 after the microphone capsule 10 is connected to the microphone case 20. As explained above, the extraction electrode 50 composed of a cylindrical conductive material forms the chamber 53 that serves as the acoustic capacitor. The fixed electrode 13 has the holes 131 extending from the air chamber between the diaphragm 12 and the fixed electrode 13 to the air chamber 53 defined by the fixed electrode 13 and the extraction electrode 50.

The extraction electrode 50 electrically connects the fixed electrode 13 to the electrical circuit members, which may be a predetermined circuit pattern of the circuit substrate 21 other than the FET 211 that serves as an impedance convertor as explained in the embodiment shown in FIG. 1.

Not only an omnidirectional condenser microphone but also an unidirectional condenser microphone can have the structure that is the feature of the electret condenser microphone according to the present invention by providing holes, for example, at the rear of the extraction electrode 50. Not only the electret condenser microphone but also any other condenser microphone may have the above-explained features according to the present invention.

In the electret condenser microphone according to the present invention, the fixed electrode is fixed to the shoulder of the extraction electrode to form the air chamber that serves as an acoustic capacitor within the extraction electrode, and a decrease in the acoustic performances such as a reduction in sensitivity and an increase in distortion by reducing the stray capacitance in the capacitor of the electret condenser microphone can be prevented. Accordingly, this prevents disadvantages in decreasing the acoustic performances such as frequency characteristics or sensitivity during assembling the microphone and biasing the fixed electrode by external force.

What is claimed is:

1. An electret condenser microphone comprising, a microphone capsule comprising:

a diaphragm that vibrates in response to sound waves;

a fixed electrode that faces the diaphragm and configures a capacitor with the diaphragm; and an extraction electrode for electrically connecting electric circuit members to the surface of the fixed electrode remote from the surface that faces the diaphragm, wherein the extraction electrode comprises a closed-bottomed cylinder composed of a conductive material, the fixed electrode has holes extending from an air chamber between the diaphragm and the fixed electrode to an air chamber defined by the extraction electrode, and the fixed electrode is fixed to a shoulder of the extraction electrode to define the air chamber that serves as an acoustic capacitor within the extraction electrode.

2. The electret condenser microphone according to claim 1, wherein the extraction electrode is disposed in the microphone capsule; and the fixed electrode and the electric circuit members are electrically connected via the extraction electrode by assembling the microphone capsule into a microphone case.

3. The electret condenser microphone according to claim 1, wherein the microphone capsule includes a capsule case accommodating the diaphragm, the fixed electrode and the extraction electrode therein.

4. The electret condenser microphone according to claim 1, wherein the extraction electrode comprises large- and small-diameter column segments that are integrally molded; and an insulating sleeve is interposed between an outer peripheral surface of the large-diameter column segment and an inner peripheral surface of the capsule case.

5. The electret condenser microphone according to claim 4, wherein the fixed electrode is fixed to a shoulder provided on an inner side at the open end of the large-diameter column segment.

6. The electret condenser microphone according to claim 4, wherein the cylindrical insulating sleeve has a convex portion on its fringe of the end adjacent the diaphragm, and the convex portion supports a fringe of the diaphragm.

7. The electret condenser microphone according to claim 1, wherein an outer peripheral surface of the large-diameter column segment and an inner peripheral surface of the insulating sleeve are attached firmly by insert molding.

* * * * *